US008234902B2

(12) United States Patent
Huang

(10) Patent No.: US 8,234,902 B2
(45) Date of Patent: Aug. 7, 2012

(54) METAL SHELL MACHINING APPARATUS

(76) Inventor: Mao-Lien Huang, Xinzhuang (TW)

( * ) Notice: Subject to any disclaimer, the term of this patent is extended or adjusted under 35 U.S.C. 154(b) by 367 days.

(21) Appl. No.: 12/698,157

(22) Filed: Feb. 2, 2010

(65) Prior Publication Data

US 2010/0313728 A1 Dec. 16, 2010

(30) Foreign Application Priority Data

Jun. 15, 2009 (TW) ..... 98210654 U

(51) Int. Cl.
*B21D 43/28* (2006.01)

(52) U.S. Cl. ..... 72/324; 72/325; 83/518; 83/690

(58) Field of Classification Search ..... 72/324, 72/325; 83/518, 531, 588, 679, 681, 682, 83/683, 684, 685, 686, 690, 692, 693, 695
See application file for complete search history.

(56) References Cited

U.S. PATENT DOCUMENTS

| | | | | |
|---|---|---|---|---|
| 3,888,161 | A * | 6/1975 | Baudermann | 409/132 |
| 6,427,508 | B1 * | 8/2002 | Lehto et al. | 72/71 |
| 6,938,452 | B2 * | 9/2005 | Rudolph et al. | 72/325 |
| 2008/0310930 | A1 * | 12/2008 | Schaeffer et al. | 411/55 |

* cited by examiner

*Primary Examiner* — Edward Tolan
*Assistant Examiner* — Homer Boyer

(57) ABSTRACT

A metal shell machining apparatus includes a cutting tool and a pressing tool. The cutting tool has a main body, at least two blade bodies, at least two enlargement portions, and at least two blade heads. The main body is a hollow cylinder, the blade bodies are formed by extending downwards from lower end of the main body, and there are at least two intervals between the blade bodies. The enlargement portions are formed by extending downwards and outwards from lower ends of the blade bodies, the blade heads are formed by extending downwards and inwards from lower ends of the enlargement portions. The pressing tool is a hollow cylinder and encircles a periphery of the cutting tool. The lower end of the pressing tool abuts the enlargement portions of the cutting tool. The apparatus can easily form oblique grooves on a metal plate, reducing manufacture cost.

8 Claims, 9 Drawing Sheets

METAL SHELL MACHINING APPARATUS

BACKGROUND OF THE INVENTION

1. Field of the Invention

The present invention relates to a metal shell machining apparatus, in particular, to a metal shell machining apparatus which forms an oblique groove on a surface of metal by using a cutting tool.

2. Description of Related Art

By the development of the technique, various electronic devices and equipments are produced. Metal working is still frequently utilized for these devices and equipments. Particularly, when shells of the devices and equipments need to assembly with many mechanical components, the metal working is a way to achieve the providing of the mechanical components.

Metal working mainly includes perforation, gouging and so on. Most of the machining apparatuses form vertical grooves in a vertical direction. This technique for forming vertical grooves is well developed, and easy to be performed. However, if the grooves are oblique to the surface of the metal, the grooves will be hard to form. The reason is that the cutting tool of the apparatus is not easy to locate in place and exert forces one the metal. Moreover, if the tool is not properly operated, the surface of the metal may be damaged. Further, the failure rate of forming the oblique grooves is high, time for forming is longer, and the costs for the money and time are increased accordingly.

Consequently, there is a need to develop a cutting tool which is easily operated, has good forming results, meets the abovementioned requirements, makes the metal working more convenient, and makes the machining cost lower.

SUMMARY OF THE INVENTION

In view of the aforementioned issues, the present invention provides a metal shell machining apparatus, which is capable of forming oblique groove on a metal surface easily.

To achieve the above-mentioned objectives, the present invention provides a metal shell machining apparatus, the apparatus comprises: a cutting tool with a hollow cylindrical shape, having a main body, at least two blade bodies, at least two enlargement portions, at least two blade heads and at least two intervals formed between the blade bodies in a lateral direction, wherein the blade bodies are formed by extending downwards from a lower end of the main body, the enlargement portions are formed by extending downwards and outwards from lower ends of the blade bodies, the blade heads are formed by extending downwards and inwards from lower ends of the enlargement portions, and the intervals penetrate an inner wall of the cutting tool; and a pressing tool with a hollow cylindrical shape for encircling an outer wall of the cutting tool, wherein the pressing tool has a lower end for disposing and abutting against the enlargement portions of the cutting tool.

Further, the present invention provides another metal shell machining apparatus, the apparatus comprises: a cutting tool with a hollow cylindrical shape, having a main body, at least two blade bodies, at least two enlargement portions, at least two blade heads and at least two intervals formed between the blade bodies in a lateral direction, wherein the blade bodies are formed by extending downwards from a lower end of the main body, the enlargement portions are formed by extending downwards and inwards from lower ends of the blade bodies, the blade heads are formed by extending downwards and outwards from lower ends of the enlargement portions, and the intervals penetrate an inner wall of the cutting tool; and a pressing tool with a cylindrical shape for being encircled by the inner wall of the cutting tool, wherein the pressing tool has a lower end for disposing and abutting against the enlargement portions of the cutting tool.

The metal shell machining apparatus of the present invention provides, at least, efficacies as follow: the apparatus is able to easily form grooves on the metal plate, wherein the grooves are oblique to the surface of the metal plate. Moreover, plural metal shell machining apparatuses can be simultaneously provided to a machining equipment, so that plural grooves can be formed on the metal plate in one step. This practice simplifies the machining process, reduces the cost for the money and time, and makes the benefit of the metal shell machining maximum.

In order to further understand the techniques, means and effects the present invention takes for achieving the prescribed objectives, the following detailed descriptions and appended drawings are hereby referred, such that, and through which, the purposes, features, and aspects of the present invention are able to be thoroughly and concretely appreciated. It is to be understood, however, that the appended drawings are provided solely for reference and illustration, without any intention that they be used for limiting the present invention.

DETAILED DESCRIPTION OF THE PREFERRED EMBODIMENTS

Figure 1:
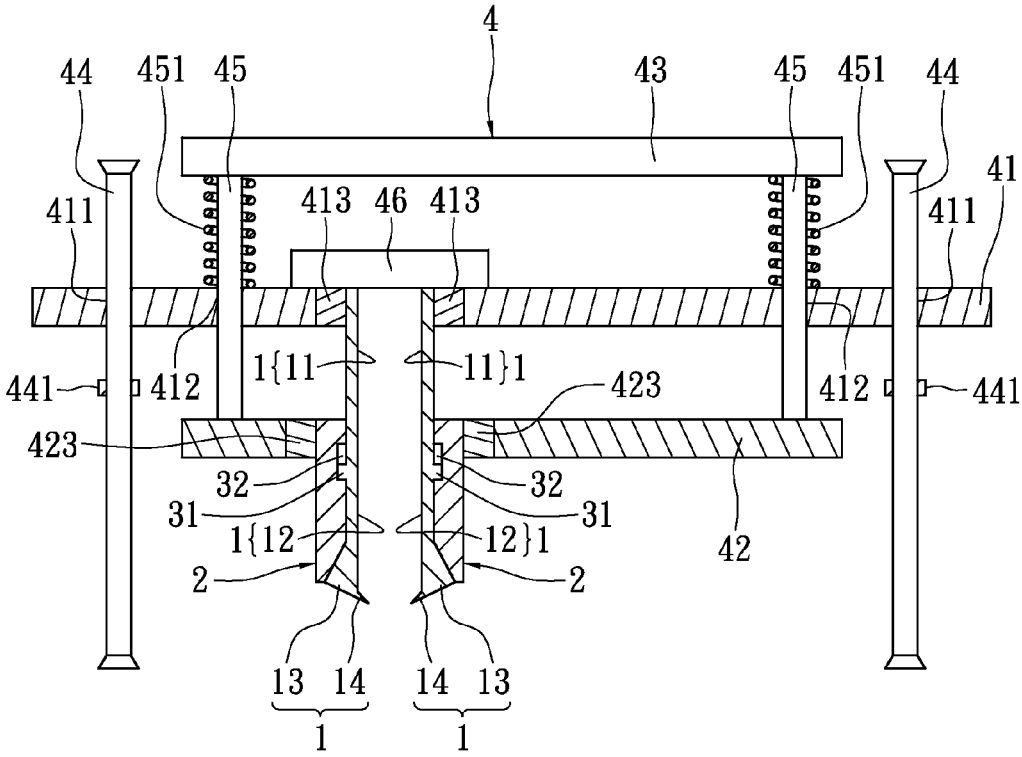
FIG. 1 is a side sectional view of a metal shell machining apparatus assembled with a machining equipment according to the present invention.
Figure 2A:
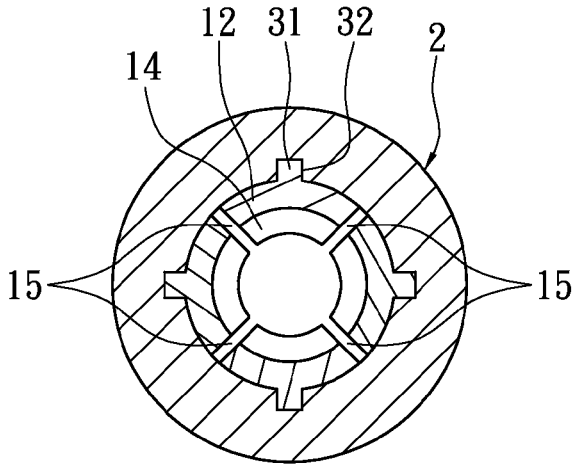
FIGS. 2A and 2B are a top sectional view and a side sectional view of the metal shell machining apparatus with an inner-hook type cutting tool according to the present invention.
Figure 2B:
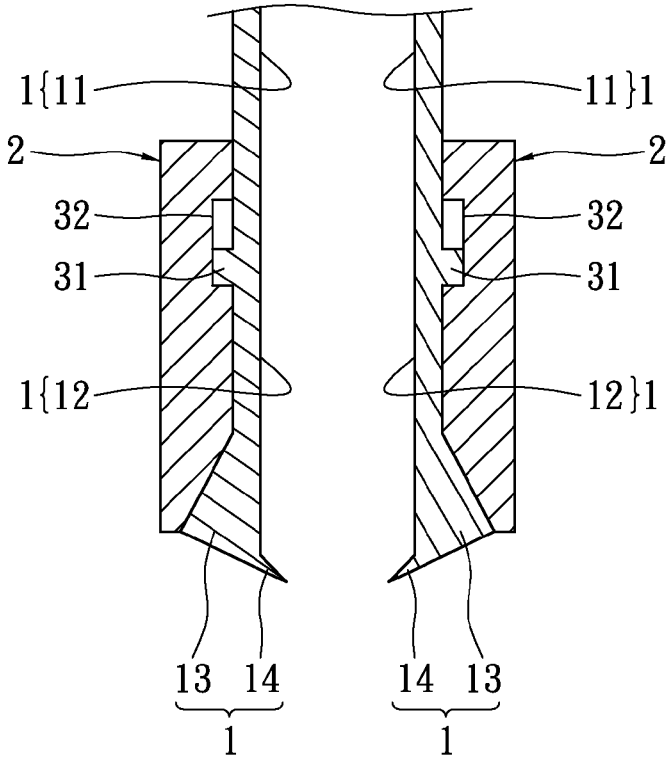

Please refer to FIGS. 1, 2A and 2B, this invention provides a metal shell machining apparatus which includes a cutting tool 1 and a pressing tool 2.

The cutting tool 1 is of a hollow cylindrical shape, and has a main body 11, at least two blade bodies 12, at least two enlargement portions 13, and at least two blade heads 14. The main body 11, the blade bodies 12, the enlargement portions 13, and the blade heads 14 are formed in one-piece formation, i.e. integrally.

As shown in FIGS. 2A and 2B, in this embodiment, the cutting tool 1 has one main body 11, four blade bodies 12, four enlargement portions 13, and four blade heads 14. The main body 11 is approximately a hollow cylinder, but not limited in this shape. The four blade bodies 12 are formed by extending downwards from the lower portion of the main body 11. There are four intervals 15 formed between the four blade bodies 12 in a lateral direction, wherein the four intervals 15 are equal, the four blade bodies 12 are divided in four equal pieces. The four intervals 15 may penetrate the side wall of the cutting tool 1 in a vertical direction and from inside to outside. The intervals 15 provide reserved spaces, so that the blade bodies 12 are able to perform inwards flexible motion. The four enlargement portions 13 are formed by extending downwards and outwards from the lower ends of the four blade bodies 12, the top surfaces of the four enlargement portions 13 and the outer walls of the blade bodies 12 form oblique angles. The four blade heads 14 are formed by extending downwards and inwards from the lower ends of the four enlargement portions 13, the blade heads 14 and the inner walls of the enlargement portions 13 form oblique angles. In this embodiment, the cutting tool 1 is an inner-hook type.

The pressing tool 2 is also of a hollow cylindrical shape, the shape and dimensions of the pressing tool 2 correspond to those of the cutting tool 1. The pressing tool 2 encircles the outer wall of the cutting tool 1, and the lower end of the pressing tool 2 disposes and abuts against the outer walls of the enlargement portions 13 of the cutting tool 1.

Figure 6A:
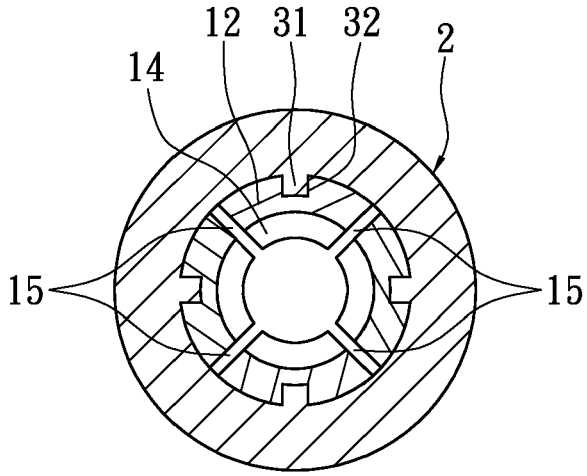
FIGS. 6A and 6B are a top sectional view and a side sectional view of the metal shell machining apparatus with the inner-hook type cutting tool according to another embodiment of the present invention.
Figure 6B:
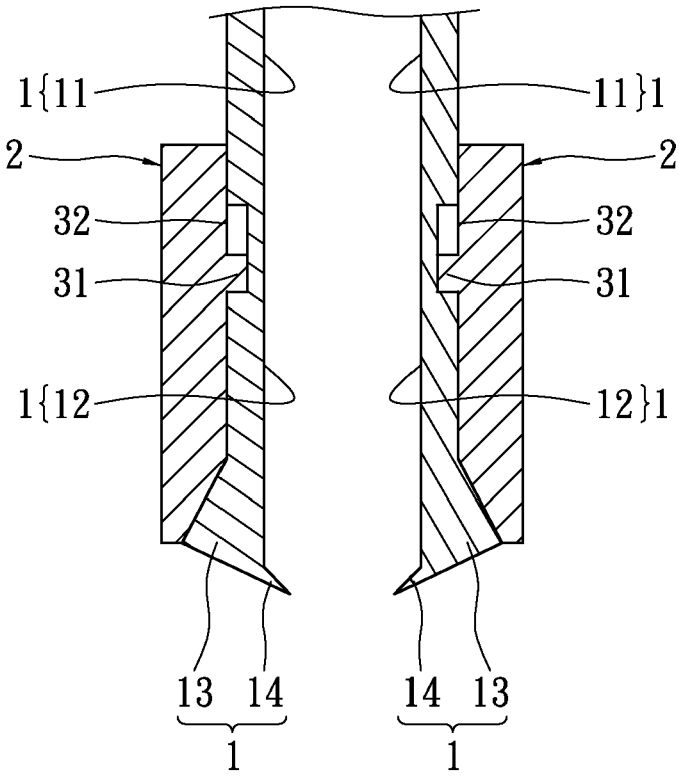

At least one tenon 31 and at least one slot 32 are further provided with the cutting tool 1 and pressing tool 2 respectively. The tenon 31 protrudes from the outer wall of the cutting tool 1, and the slot 32 is dented on the inner wall of the pressing tool 2. The number and position of the tenon 31 correspond to those of the slot 32. The tenon 31 is accommodated in the slot 32, so that the cutting tool 1 and pressing tool 2 can drive each other to rotate together around their axes. The length of the slot 32 is longer than that of the tenon 31 in a vertical direction, so that the cutting tool 1 and the pressing tool 2 can slide against each other along a vertical, or longitudinal, direction. However, the positions of the tenon 31 and the slot 32 are not limited by the cutting tool 1 and pressing tool 2, they can be interchangeable. As shown in FIGS. 6A and 6B, the slot 32 is dented on the outer wall of the cutting tool 1, and the tenon 31 protrudes from the inner wall of the pressing tool 2.

Please refer to FIG. 1, when used, the metal shell machining apparatus may need to assemble with a machining equipment 4. The machining equipment 4 has a first platform 41, a second platform 42, a third platform 43, at least two first columns 44, at least two second columns 45, and a driving device 46. The first platform 41 is located between the second and third platforms 42, 43, and the three platforms are parallel to each other. The first platform 41 has at least two first holes 411 and at least two second holes 412 penetrating the first platform 41. The first column 44 pierces the first hole 411 of the first platform 41, so that the first platform 41 can move upwards or downwards along the first columns 44. The first columns 44 are respectively provided with a blocking element 441 for restricting the downward movement of the first platform 41, so the first platform 41 has a lowest position which is defined as an "initial cutting position."

The second column 45 pierces the second hole 412 of the first platform 41, and the upper and lower ends of the second column 45 are fixed to the second and third platforms 42, 43 respectively. The second and third platforms 42, 43 can move upwards or downwards against the first platform 41 via the second column 45 piercing the second hole 412. Each of the second columns 45 has a spring 451 encircling the second column 45. In this embodiment, the springs 451 are located between the first and third platforms 41, 43 for providing elastic force for buffering and returning. The springs 451 may be located between the first and second platforms 41, 42 in other embodiments.

The first platform 41 has a rotatable cutting-tool bearing 413 which pierces the first platform 41, connects the upper end of the main body 11 of the cutting tool 1, and allows the cutting tool 1 to rotate around the axis of the cutting-tool bearing 413. The second platform 42 has a rotatable pressing-tool bearing 423 which pierces the second platform 42, the bearing 423 is located under the cutting-tool bearing 413, connects the upper end of the pressing tool 2, and allows the pressing tool 2 to rotate around the axis of the pressing-tool bearing 423.

The driving device 46 has motor, gears, belts and so on, which are not described herein. The driving device 46 connects each element of the machining equipment 4, and can drive the cutting-tool bearing 413 and the pressing-tool bearing 423 to rotate together, making the cutting tool 1 and the pressing tool 2 rotate together. Alternatively, the driving device 46 can only drive one of the cutting-tool bearing 413 and the pressing-tool bearing 423 to rotate alone, the tenon 31 and the slot 32 will make the cutting tool 1 and the pressing tool 2 rotate together. The driving device 46 also can drive the first, second and third platforms 41, 42, 43 to move upwards or downwards.

Figure 3:
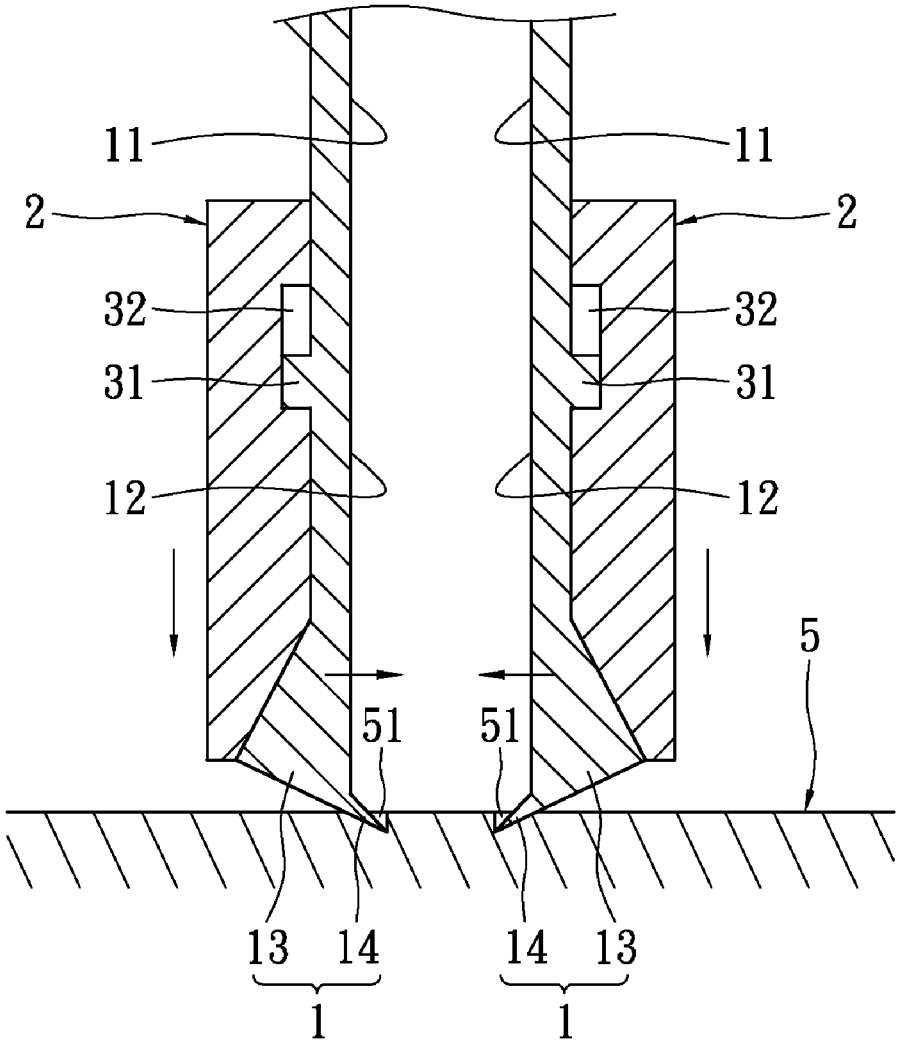
FIG. 3 is a schematic view showing the uses of the metal shell machining apparatus according to the present invention.

Please refer to FIGS. 1 and 3, when manufactured, a metal plate 5 is placed under the metal shell machining apparatus. The cutting tool 1 and pressing tool 2 rotate together around axes, and the first platform 41 makes the cutting tool 1 move downwards to the initial cutting position, that is, the first platform 41 contacts the blocking elements 441 and stops moving downwards. In the meanwhile, the blades head 14 slightly cuts a shallow groove 51.

Figure 4A:
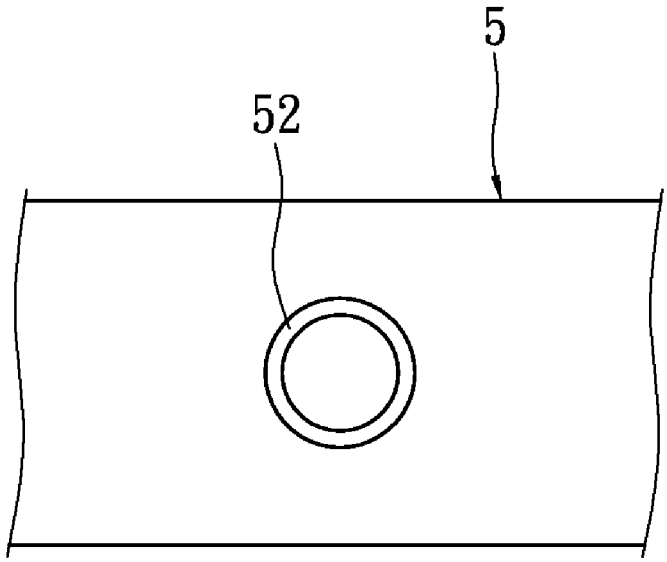
FIGS. 4A and 4B are a top view and a sectional view showing a metal plate has been machined by the rotation of the metal shell machining apparatus with the inner-hook type cutting tool according to the present invention.
Figure 4B:
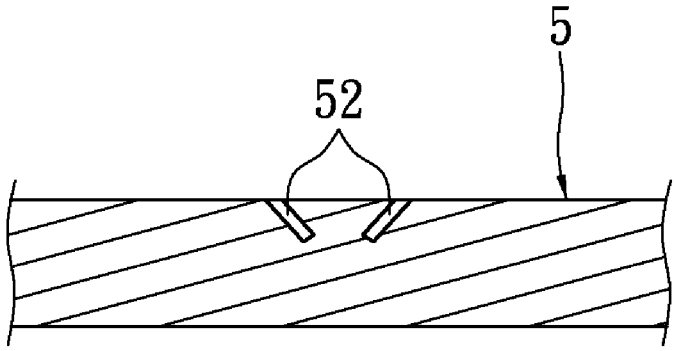

Then the second and third platforms 42, 43 continue to make the pressing tool 2 move downwards. In the meantime, the inner wall of the lower end of the pressing tool 2 presses the enlargement portions 13, forcing the lower ends of the enlargement portions 13 to move closer to each other, and further making the blade heads 14 cut inwards to dig up the groove 52 shown in the FIGS. 4A, and 4B.

When the manufacture of the groove 52 is finished, the driving device 46 first drives the second and third platforms 42, 43 to move the pressing tool 2 upwards. In this meantime, the pressing tool 2 no longer presses the enlargement portions 13 of the cutting tool 1, making the enlargement portions 13 and the blade heads 14 return to their original positions. Then, the first platform 41 makes the cutting tool 1 move upwards to leave the surface of the metal plate 5. Following this procedure can avoid damaging the finished groove 52 caused by the existing of the blade heads 14.

Figure 5A:
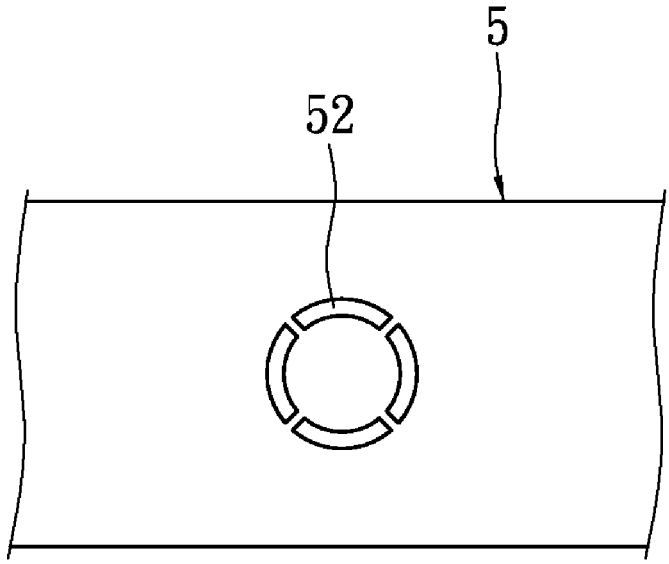
FIGS. 5A and 5B are a top view and a sectional view showing a metal plate has been machined by the stamping of the metal shell machining apparatus with the inner-hook type cutting tool according to the present invention.
Figure 5B:
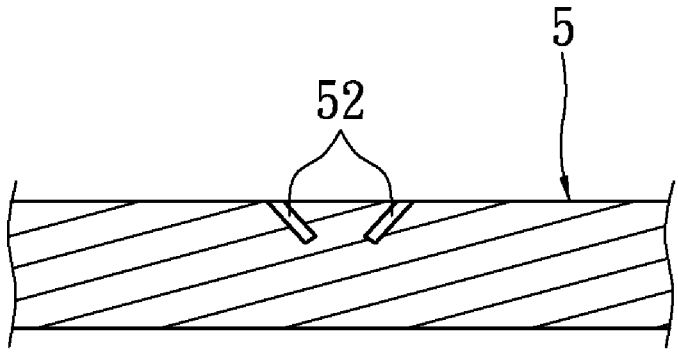

In this embodiment, the cutting tool 1 is inner-hook type. Because the cutting tool 1 is in rotation while manufacturing, the finished groove 52 is shown in the FIGS. 4A and 4B. In top view, the groove 52 is circle-shaped; in sectional view, the groove 52 and the surface of the metal plate 5 form inner-hook type an oblique angle. Without rotating, the cutting tool 1 and the pressing tool 2 still are able to form the groove 52, shown in the FIGS. 5A, and 5B, by stamping directly. In top view, the groove 52 is shaped like circle with intervals; in sectional view, the groove 52 and the surface of the metal plate 5 still form the oblique angle. If the inner walls of the blade heads 14 are other shapes, the finished groove 52 may be other shapes.

Figure 7A:
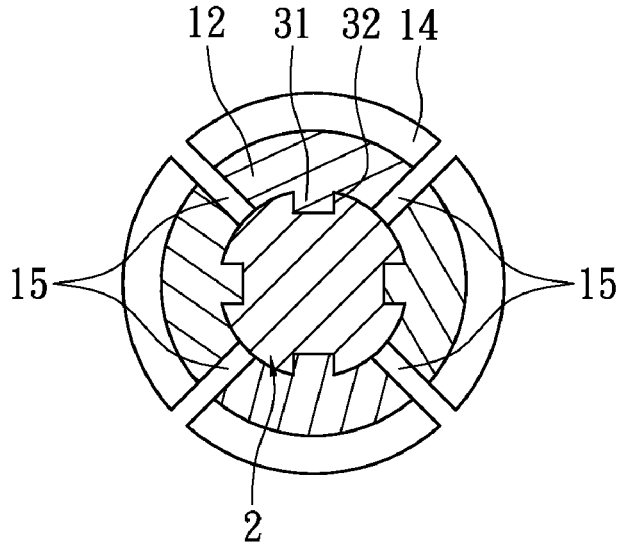
FIGS. 7A and 7B are a top sectional view and a side sectional view of the metal shell machining apparatus with an outer-hook type cutting tool according to the present invention.
Figure 7B:
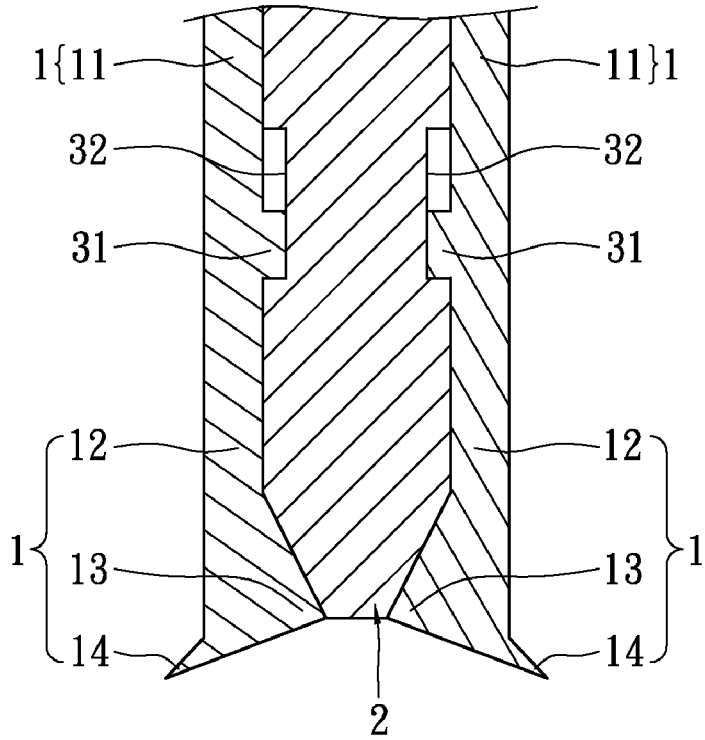

As shown in FIGS. 7A and 7B, in another embodiment, the cutting tool 1 is of a hollow cylindrical shape, and has one main body 11, four blade bodies 12, four enlargement portions 13, and four blade heads 14. The main body 11 is approximately a hollow cylinder, but not limited in this shape.

The four blade bodies 12 are formed by extending downwards from the lower portion of the main body 11. There are four intervals 15 formed between the four blade bodies 12 in a lateral direction, wherein the four intervals 15 are equal, the four blade bodies are divided in four equal pieces. The four intervals 15 may penetrate the side wall of the cutting tool 1 in a vertical direction and from inside to outside. The intervals 15 provide reserved spaces, so that the blade bodies 12 are able to perform outwards flexible motion.

The four enlargement portions 13 are formed by extending downwards and inwards from the lower ends of the four blade bodies 12, the top surfaces of the four enlargement portions 13 and the inner walls of the blade bodies 12 form oblique angles. The four blade heads 14 are formed by extending downwards and outwards from the lower ends of the four enlargement portions 13, the blade heads 14 and the outer walls of the enlargement portions 13 form oblique angles. In this embodiment, the cutting tool 1 is an outer-hook type.

The pressing tool 2 is approximately of a solid cylindrical shape, the shape and dimensions of the pressing tool 2 correspond to those of the cutting tool 1. The cutting tool 1 encircles the outer wall of the pressing tool 2, and the outer wall of the lower end of the pressing tool 2 disposes and abuts against the enlargement portions 13 of the cutting tool 1.

Figure 8A:
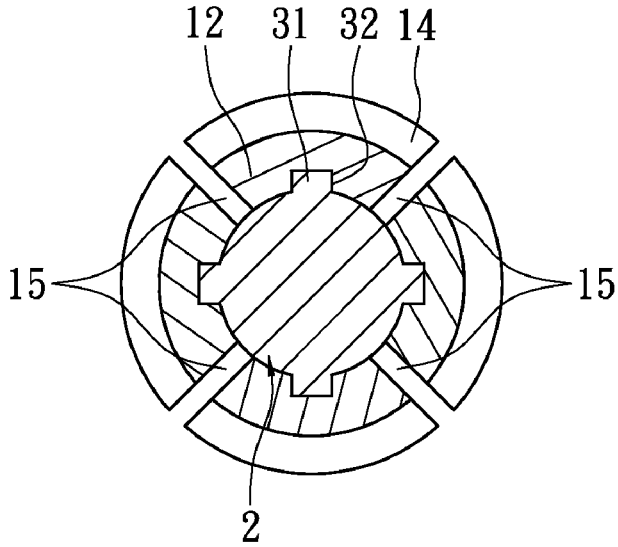
FIGS. 8A and 8B are a top sectional view and a side sectional view of the metal shell machining apparatus with the outer-hook type cutting tool according to another embodiment of the present invention.
Figure 8B:
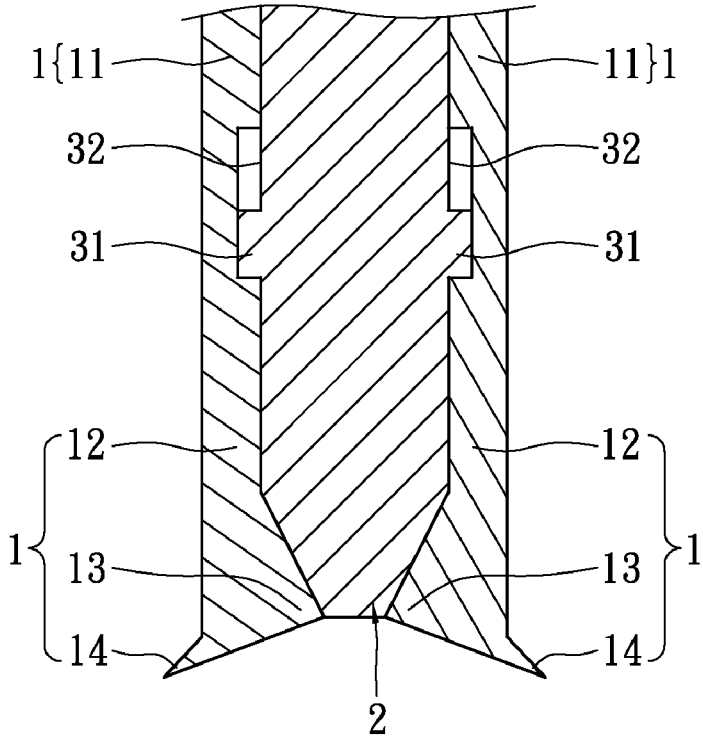

At least one tenon 31 and at least one slot 32 are further provided with the cutting tool 1 and pressing tool 2 respectively. The tenon 31 protrudes from the inner wall of the cutting tool 1, and the slot 32 is dented on the outer wall of the pressing tool 2. The number and position of the tenon 31 correspond to those of the slot 32. The tenon 31 is provided in the slot 32, so that the cutting tool 1 and pressing tool 2 can drive each other to rotate together around their axes. The length of the slot 32 is longer than that of the tenon 31 in a vertical direction, so that the cutting tool 1 and the pressing tool 2 can slide against each other along the vertical, or longitudinal, direction. However, the positions of the tenon 31 and the slot 32 are not limited by the cutting tool 1 and pressing tool 2, they can be interchangeable. As shown in FIGS. 8A and 8B, the slot 32 is dented on the inner wall of the cutting tool 1, and the tenon 31 protrudes from the outer wall of the pressing tool 2.

Figure 9A:
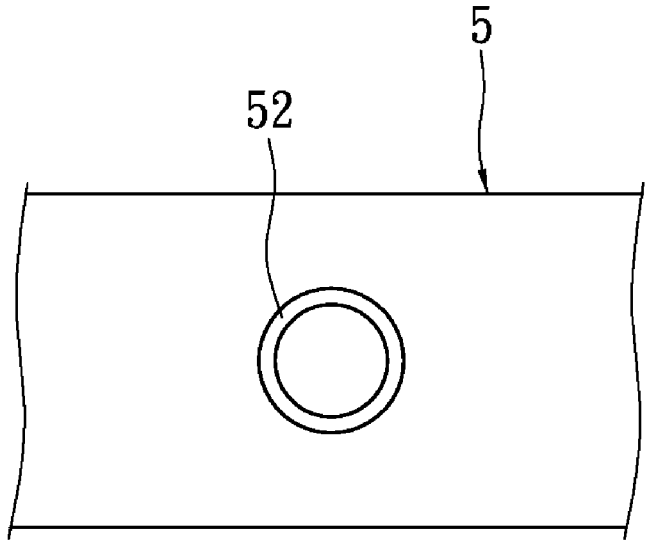
FIGS. 9A and 9B are a top view and a sectional view showing a metal plate has been machined by the rotation of the metal shell machining apparatus with the outer-hook type cutting tool according to the present invention.
Figure 9B:
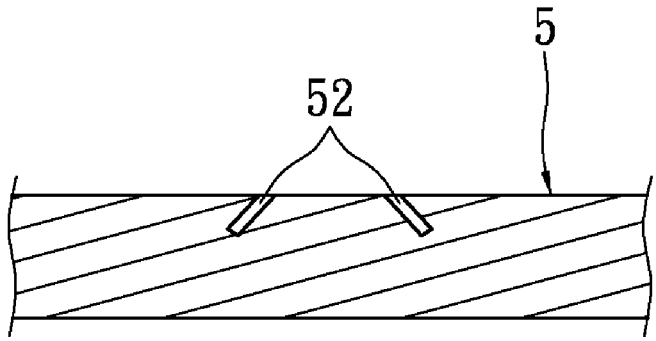

In the embodiment, the cutting tool 1 is outer-hook type. If the cutting tool 1 rotates during manufacturing, the finished groove 52 is shown in FIGS. 9A and 9B. In top view, the groove 52 is shaped like circle; in sectional view, the groove 52 and the surface of the metal plate 5 form outer-hook type oblique angles.

As mentioned above, the metal shell machining apparatus of this invention is provide in the machining equipment 4, and can easily form groove 52 on the metal plate 5, wherein the groove 52 is oblique to the surface of the metal plate 5. Moreover, based on the need, plural cutting tools 1 and pressing tools 2 can be simultaneously provided to the machining equipment 4, so that plural grooves 52 can be formed on the metal plate 5 in one step, simplifying the machining process, reducing the cost for the money and time, and making the benefit of the metal shell machining maximum.

The above-mentioned descriptions represent merely the preferred embodiment of the present invention, without any intention to limit the scope of the present invention. Various equivalent changes, alternations or modifications based on the claims of the present invention are all consequently viewed as being embraced by the scope of the present invention.

What is claimed is:

1. A metal shell machining apparatus comprising:

a cutting tool with a hollow cylindrical shape, having a main body, at least two blade bodies, at least two enlargement portions, at least two blade heads and at least two intervals formed between the blade bodies in a lateral direction, wherein the blade bodies are formed by extending downwards from a lower end of the main body, the enlargement portions are formed by extending downwards and outwards from lower ends of the blade bodies, the blade heads are formed by extending downwards and inwards from lower ends of the enlargement portions, the intervals penetrate an inner wall of the cutting tool; and a pressing tool with a hollow cylindrical shape for encircling an outer wall of the cutting tool, wherein the pressing tool has a lower end for disposing and abutting against the enlargement portions of the cutting tool.

2. The apparatus of claim 1, wherein the main body, the blade bodies, the enlargement portions and the blade heads are formed in one-piece formation.

3. The apparatus of claim 1, wherein the cutting tool has a tenon protruded on the outer wall thereof, and the pressing tool has a slot dented on an inner wall thereof for accommodating the tenon of the cutting tool, wherein a length of the slot is longer than that of the tenon in a vertical direction.

4. The apparatus of claim 1, wherein the cutting tool has a slot dented on the outer wall thereof, and the pressing tool has a tenon protruded on an inner wall thereof for being accommodated in the slot of the cutting tool, wherein a length of the slot is longer than that of the tenon in a vertical direction.

5. A metal shell machining apparatus, comprising:

a cutting tool with a hollow cylindrical shape, having a main body, at least two blade bodies, at least two enlargement portions, at least two blade heads and at least two intervals formed between the blade bodies in a lateral direction, wherein the blade bodies are formed by extending downwards from a lower end of the main body, the enlargement portions are formed by extending downwards and inwards from lower ends of the blade bodies, the blade heads are formed by extending downwards and outwards from lower ends of the enlargement portions, the intervals penetrate an inner wall of the cutting tool; and a pressing tool with a cylindrical shape for being encircled by the inner wall of the cutting tool, wherein the pressing tool has a lower end for disposing and abutting against the enlargement portions of the cutting tool.

6. The apparatus of claim 5, wherein the main body, the blade bodies, the enlargement portions and the blade heads are formed in one-piece formation.

7. The apparatus of claim 5, wherein the cutting tool has a tenon protruded on the inner wall thereof, and the pressing tool has a slot dented on an outer wall thereof for accommodating the tenon of the cutting tool, wherein a length of the slot is longer than that of the tenon in a vertical direction.

8. The apparatus of claim 5, wherein the cutting tool has a slot dented on the inner wall thereof, and the pressing tool has a tenon protruded on an outer wall thereof for being accommodated in the slot of the cutting tool, wherein a length of the slot is longer than that of the tenon in a vertical direction.

* * * * *